US005930554A

United States Patent [19]

Godlove

[11] Patent Number: 5,930,554

[45] Date of Patent: Jul. 27, 1999

[54] APPARATUS AND METHOD FOR NON-INTERACTIVE MAGNETIC BRUSH DEVELOPMENT

[75] Inventor: Ronald E. Godlove, Bergen, N.Y.

[73] Assignee: Xerox Corporation, Stamford, Conn.

[21] Appl. No.: 09/003,700

[22] Filed: Jan. 7, 1998

[51] Int. Cl.[6] ..... G03G 15/08

[52] U.S. Cl. ..... 399/55; 399/9; 399/285

[58] Field of Search ..... 399/55, 9, 37, 399/270, 271, 285; 430/120, 122

[56] References Cited

U.S. PATENT DOCUMENTS 4,862,828 9/1989 Kumasaka et al. ..... 430/122 X 5,034,775 7/1991 Folkins ..... 399/55

*Primary Examiner*—R. L. Moses

*Attorney, Agent, or Firm*—Lloyd F. Bean II

[57] ABSTRACT

A development system including a developer transport adapted for depositing developer material on an imaging surface having an electrostatic latent image thereon, including a housing defining a chamber storing a supply of developer material including toner. A donor member is mounted partially in said chamber and spaced from the imaging surface, for transporting toner on an outer surface thereof to a region opposed from the imaging surface. The toner donor member has a magnetic assembly which includes a plurality of poles and a sleeve, enclosing said magnetic assembly and rotating about said magnetic assembly. A sensor measures a magnetic field of said donor roll at a predefined position on said donor roll. A control system generates an electric field continuously optimize the development of toner regardless of the ever changing height of the developer bed.

6 Claims, 3 Drawing Sheets

APPARATUS AND METHOD FOR NON-INTERACTIVE MAGNETIC BRUSH DEVELOPMENT

BACKGROUND OF THE PRESENT INVENTION

The invention relates generally to an electrophotographic printing machine and, more particularly, to a development system which includes a magnetic developer roll for transporting developer material to a development zone; and a system for generating an electric field that compensates for variations in developer material bed height in the development zone.

INCORPORATED BY REFERENCE

The following are incorporated for there teachings U.S. application Ser. No. 09/004,465 entitled "NON-INTERACTIVE AGITATED MAGNETIC BRUSH DEVELOPMENT" application filed herewith.

Generally, an electrophotographic printing machine includes a photoconductive member which is charged to a substantially uniform potential to sensitize the surface thereof. The charged portion of the photoconductive member is exposed to an optical light pattern representing the document being produced. This records an electrostatic latent image on the photoconductive member corresponding to the informational areas contained within the document. After the electrostatic latent image is formed on the photoconductive member, the image is developed by bringing a developer material into proximal contact therewith. Typically, the developer material comprises toner particles adhering triboelectrically to carrier granules. The toner particles are attracted to the latent image from the carrier granules and form a powder image on the photoconductive member which is subsequently transferred to a copy sheet. Finally, the copy sheet is heated or otherwise processed to permanently affix the powder image thereto in the desired image-wise configuration.

In the prior art, both interactive and non-interactive development has been accomplished with magnetic brushes. In typical interactive embodiments, the magnetic brush is in the form of a rigid cylindrical sleeve which rotates around a fixed assembly of permanent magnets. In this type development system, the cylindrical sleeve is usually made of an electrically conductive, non-ferrous material such as aluminum or stainless steel, with its outer surface textured to improve developer adhesion. The rotation of the sleeve transports magnetically adhered developer through the development zone where there is direct contact between the developer brush and the imaged surface, and toner is stripped from the passing magnetic brush filaments by the electrostatic fields of the image.

Non-interactive development is most useful in color systems when a given color toner must be deposited on an electrostatic image without disturbing previously applied toner deposits of a different color or cross-contaminating the color toner supplies.

U.S. Pat. No. 5,409,791 to Kaukeinen et al. describes a non-interactive magnetic brush development method employing a rotating magnetic multipole core within a passive sleeve to provide a regular matrix of surface gradients that attract magnetic carrier to the sleeve. As the core rotates in one direction within the sleeve, the magnetic field lines rotate in the opposite sense at the surface of the sleeve, causing the brush filaments to follow suit. The collective tumbling action of the filaments transports bulk developer material along the sleeve surface. The mechanical agitation inherent in the rotating filaments dislodges toner particles from the carrier beads that form the brush filaments making them available for transport across a gap to the photoreceptor surface under the influence of the proximal development fields of the image. U.S. Pat. No. 5,409,791 assigned to Eastman Kodak Company is hereby incorporated by reference.

It has been observed that the magnetic brush height formed by the developer mass in the magnetic fields on the sleeve surface in this type development system is periodic in thickness and statistically noisy as a result of complex carrier bead agglomeration and filament exchange mechanisms that occur during operation. As a result, values of developer biasing must be adopted that are ideal for that instant when the bed is the highest and less than ideal for the remainder of the pole to pole cycle. The magnetic pole spacing cannot be reduced to an arbitrarily small size because allowance for the thickness of the sleeve and a reasonable mechanical clearance between the sleeve and the rotating magnetic core sets a minimum working range for the magnetic multipole forces required to both hold and tumble the developer blanket on the sleeve. Since the internal pole geometry defining the spatial wavelength of the tumbling component also governs the magnitude of the holding forces for the developer blanket at any given range, there is only one degree of design freedom available to satisfy the opposing system requirements of short spatial wavelength and strong holding force. Reducing the developer blanket mass by supply starvation has been found to result in a sparse brush structure without substantially reducing the brush filament lengths or improving the uneven length distribution.

SUMMARY OF THE INVENTION

The present invention obviates the problems noted above by utilizing a development system including; a development system including a developer transport adapted for depositing developer material on an imaging surface having an electrostatic latent image thereon, comprising; a housing defining a chamber storing a supply of developer material comprising toner; a donor member, mounted partially in said chamber and spaced from the imaging surface, for transporting toner on an outer surface thereof to a region opposed from the imaging surface, said toner donor member having a magnetic assembly having a plurality of poles, a sleeve, enclosing said magnetic assembly, rotating about said magnetic assembly; a sensor for measuring a magnetic field of said donor roll at a predefined position on said donor roll; and means, responsive to sensor, for generating an electric field.

Inasmuch as the art of electrophotographic printing is well known, the various processing stations employed in the printing machine will be shown hereinafter schematically and their operation described briefly with reference thereto.

Figure 1:
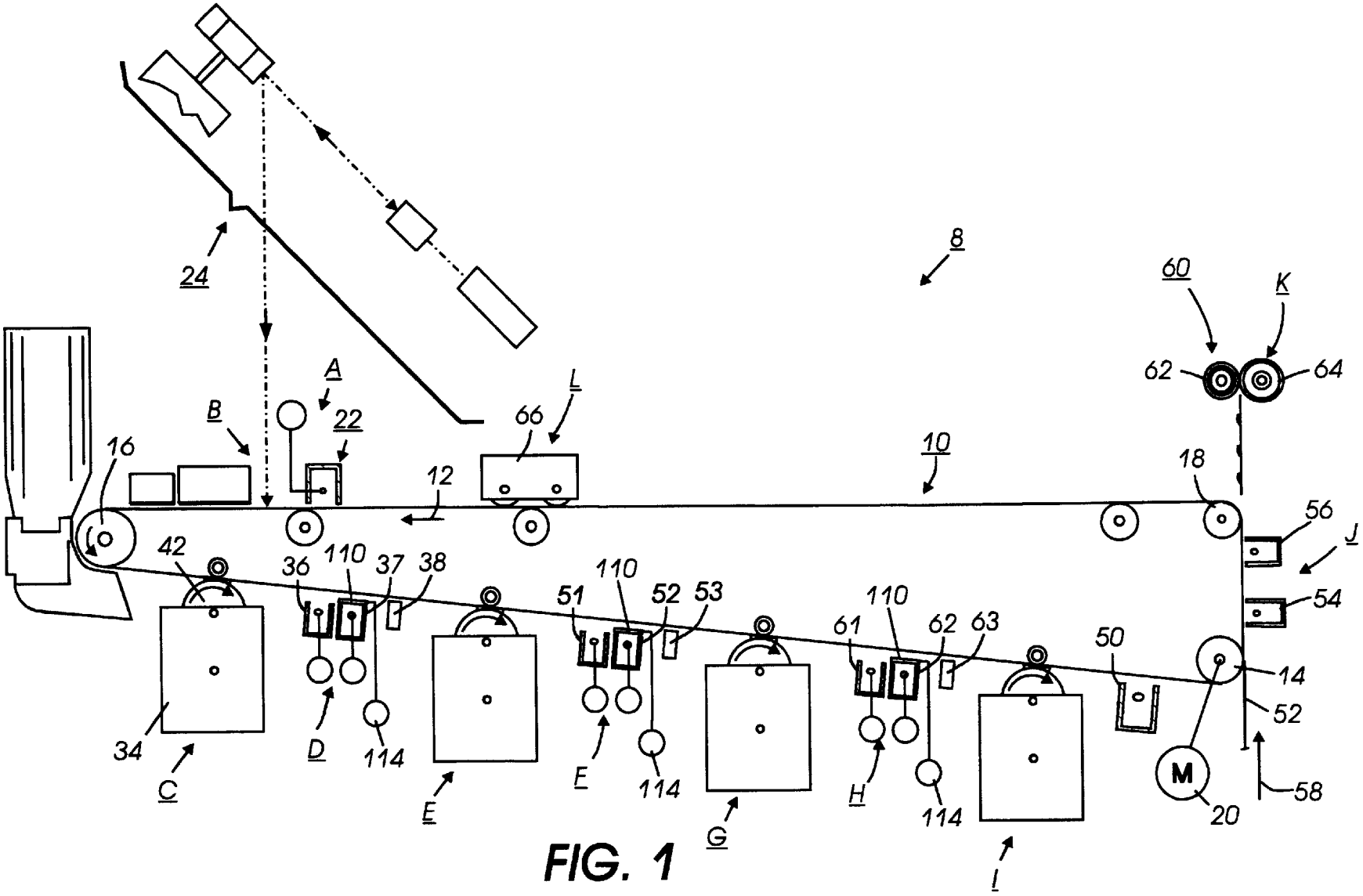
FIG. 1 is a schematic elevational view of an illustrative electrophotographic printing or imaging machine or apparatus incorporating a development apparatus having the features of the present invention therein.

Referring initially to FIG. 1, there is shown an illustrative electrophotographic machine having incorporated therein the development apparatus of the present invention. An electrophotographic printing machine 8 creates a color image in a single pass through the machine and incorporates the features of the present invention. The printing machine 8 uses a charge retentive surface in the form of an Active Matrix (AMAT) photoreceptor belt 10 which travels sequentially through various process stations in the direction indicated by the arrow 12. Belt travel is brought about by mounting the belt about a drive roller 14 and two tension rollers 16 and 18 and then rotating the drive roller 14 via a drive motor 20.

As the photoreceptor belt moves, each part of it passes through each of the subsequently described process stations. For convenience, a single section of the photoreceptor belt, referred to as the image area, is identified. The image area is that part of the photoreceptor belt which is to receive the toner powder images which, after being transferred to a substrate, produce the final image. While the photoreceptor belt may have numerous image areas, since each image area is processed in the same way, a description of the typical processing of one image area suffices to fully explain the operation of the printing machine.

Figure 2A:
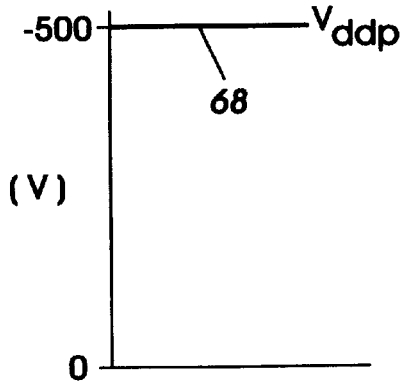
FIG. 2A shows a typical voltage profile of an image area in the electrophotographic printing machines illustrated in FIG. 1 after that image area has been charged.

As the photoreceptor belt 10 moves, the image area passes through a charging station A. At charging station A, a corona generating device, indicated generally by the reference numeral 22, charges the image area to a relatively high and substantially uniform potential. FIG. 2A illustrates a typical voltage profile 68 of an image area after that image area has left the charging station A. As shown, the image area has a uniform potential of about −500 volts. In practice, this is accomplished by charging the image area slightly more negative than −500 volts so that any resulting dark decay reduces the voltage to the desired −500 volts. While FIG. 2A shows the image area as being negatively charged, it could be positively charged if the charge levels and polarities of the toners, recharging devices, photoreceptor, and other relevant regions or devices are appropriately changed.

Figure 2B:
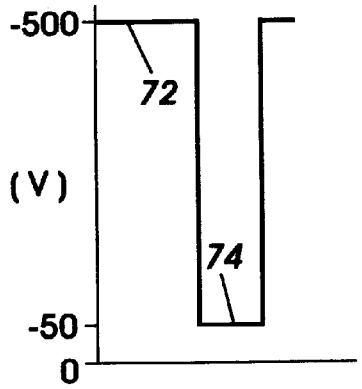
FIG. 2B shows a typical voltage profile of the image area after being exposed.

After passing through the charging station A, the now charged image area passes through a first exposure station B. At exposure station B, the charged image area is exposed to light which illuminates the image area with a light representation of a first color (say black) image. That light representation discharges some parts of the image area so as to create an electrostatic latent image. While the illustrated embodiment uses a laser based output scanning device 24 as a light source, it is to be understood that other light sources, for example an LED printbar, can also be used with the principles of the present invention. FIG. 2B shows typical voltage levels, the levels 72 and 74, which might exist on the image area after exposure. The voltage level 72, about −500 volts, exists on those parts of the image area which were not illuminated, while the voltage level 74, about −50 volts, exists on those parts which were illuminated. Thus after exposure, the image area has a voltage profile comprised of relative high and low voltages.

After passing through the first exposure station B, the now exposed image area passes through a first development station C which is identical in structure with development system E, G, and I. The first development station C deposits a first color, say black, of negatively charged toner 31 onto the image area. That toner is attracted to the less negative sections of the image area and repelled by the more negative sections. The result is a first toner powder image on the image area.

For the first development station C, development system 34 includes a donor roll 42. Donor roll 42 is mounted, at least partially, in the chamber of developer housing 44. The chamber in developer housing 44 stores a supply of developer (toner) material develops the image.

Figure 2C:
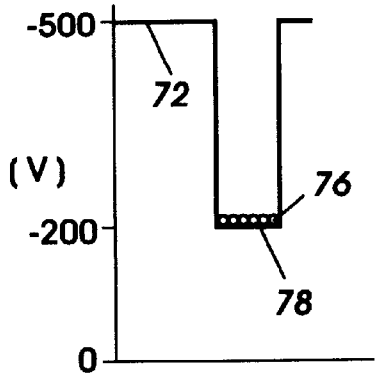
FIG. 2C shows a typical voltage profile of the image area after being developed.

FIG. 2C shows the voltages on the image area after the image area passes through the first development station C. Toner 76 (which generally represents any color of toner) adheres to the illuminated image area. This causes the voltage in the illuminated area to increase to, for example, about −200 volts, as represented by the solid line 78. The unilluminated parts of the image area remain at about the level 72.

After passing through the first development station C, the now exposed and toned image area passes to a first recharging station D. The recharging station D is comprised of two corona recharging devices, a first recharging device 36 and a second recharging device 37, which act together to recharge the voltage levels of both the toned and untoned parts of the image area to a substantially uniform level. It is to be understood that power supplies are coupled to the first and second recharging devices 36 and 37, and to any grid or other voltage control surface associated therewith, as required so that the necessary electrical inputs are available for the recharging devices to accomplish their task.

Figure 2D:
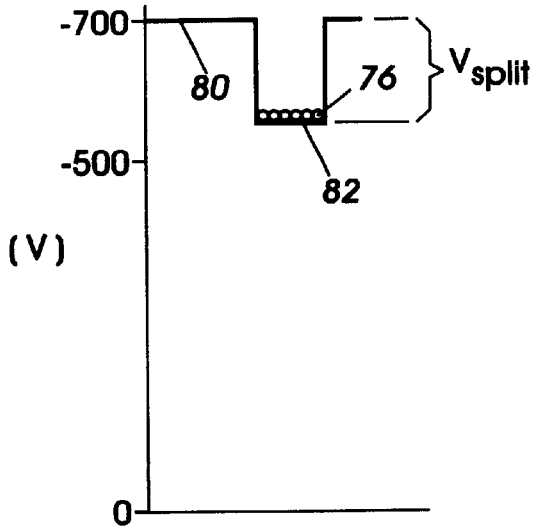
FIG. 2D shows a typical voltage profile of the image area after being recharged by a first recharging device.

FIG. 2D shows the voltages on the image area after it passes through the first recharging device 36. The first recharging device overcharges the image area to more negative levels than that which the image area is to have when it leaves the recharging station D. For example, as shown in FIG. 2D the toned and the untoned parts of the image area, reach a voltage level 80 of about −700 volts. The first recharging device 36 is preferably a DC scorotron.

Figure 2E:
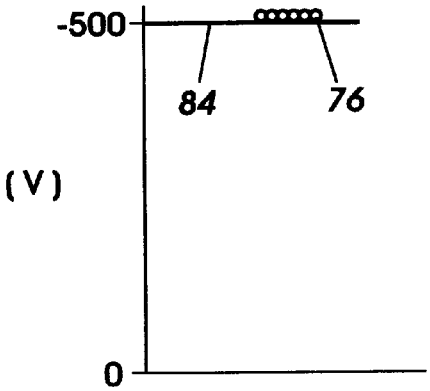
FIG. 2E shows a typical voltage profile of the image area after being recharged by a second recharging device.

After being recharged by the first recharging device 36, the image area passes to the second recharging device 37. Referring now to FIG. 2E, the second recharging device 37 reduces the voltage of the image area, both the untoned parts and the toned parts (represented by toner 76) to a level 84 which is the desired potential of −500 volts.

Figure 2F:
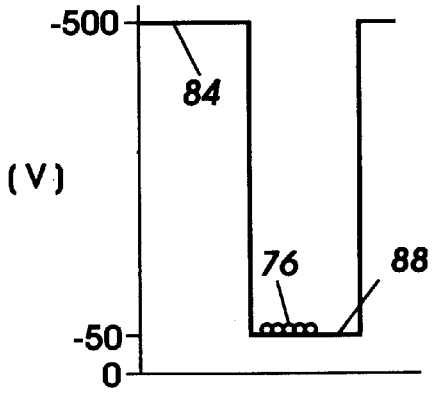
FIG. 2F shows a typical voltage profile of the image area after being exposed for a second time.

After being recharged at the first recharging station D, the now substantially uniformly charged image area with its first toner powder image passes to a second exposure station 38. Except for the fact that the second exposure station illuminates the image area with a light representation of a second color image (say yellow) to create a second electrostatic latent image, the second exposure station 38 is the same as the first exposure station B. FIG. 2F illustrates the potentials on the image area after it passes through the second exposure station. As shown, the non-illuminated areas have a potential about −500 as denoted by the level 84. However, illuminated areas, both the previously toned areas denoted by the toner 76 and the untoned areas are discharged to about −50 volts as denoted by the level 88.

The image area then passes to a second development station E. Except for the fact that the second development station E contains a toner 40 which is of a different color (yellow) than the toner 31 (black) in the first development station C, the second development station is beneficially the same as the first development station. Since the toner 40 is attracted to the less negative parts of the image area and repelled by the more negative parts, after passing through the second development station E the image area has first and second toner powder images which may overlap.

The image area then passes to a second recharging station F. The second recharging station F has first and second recharging devices, the devices 51 and 52, respectively, which operate similar to the recharging devices 36 and 37. Briefly, the first corona recharge device 51 overcharges the image areas to a greater absolute potential than that ultimately desired (say −700 volts) and the second corona recharging device, comprised of coronodes having AC potentials, neutralizes that potential to that ultimately desired.

The now recharged image area then passes through a third exposure station 53. Except for the fact that the third exposure station illuminates the image area with a light representation of a third color image (say magenta) so as to create a third electrostatic latent image, the third exposure station 38 is the same as the first and second exposure stations B and 38. The third electrostatic latent image is then developed using a third color of toner 55 (magenta) contained in a third development station G.

The now recharged image area then passes through a third recharging station H. The third recharging station includes a pair of corona recharge devices 61 and 62 which adjust the voltage level of both the toned and untoned parts of the image area to a substantially uniform level in a manner similar to the corona recharging devices 36 and 37 and recharging devices 51 and 52.

After passing through the third recharging station the now recharged image area then passes through a fourth exposure station 63. Except for the fact that the fourth exposure station illuminates the image area with a light representation of a fourth color image (say cyan) so as to create a fourth electrostatic latent image, the fourth exposure station 63 is the same as the first, second, and third exposure stations, the exposure stations B, 38, and 53, respectively. The fourth electrostatic latent image is then developed using a fourth color toner 65 (cyan) contained in a fourth development station 1.

To condition the toner for effective transfer to a substrate, the image area then passes to a pretransfer corotron member 50 which delivers corona charge to ensure that the toner particles are of the required charge level so as to ensure proper subsequent transfer.

After passing the corotron member 50, the four toner powder images are transferred from the image area onto a support sheet 52 at transfer station J. It is to be understood that the support sheet is advanced to the transfer station in the direction 58 by a conventional sheet feeding apparatus which is not shown. The transfer station J includes a transfer corona device 54 which sprays positive ions onto the backside of sheet 52. This causes the negatively charged toner powder images to move onto the support sheet 52. The transfer station J also includes a detack corona device 56 which facilitates the removal of the support sheet 52 from the printing machine 8.

After transfer, the support sheet 52 moves onto a conveyor (not shown) which advances that sheet to a fusing station K. The fusing station K includes a fuser assembly, indicated generally by the reference numeral 60, which permanently affixes the transferred powder image to the support sheet 52. Preferably, the fuser assembly 60 includes a heated fuser roller 62 and a backup or pressure roller 64. When the support sheet 52 passes between the fuser roller 62 and the backup roller 64 the toner powder is permanently affixed to the sheet support 52. After fusing, a chute, not shown, guides the support sheets 52 to a catch tray, also not shown, for removal by an operator.

After the support sheet 52 has separated from the photoreceptor belt 10, residual toner particles on the image area are removed at cleaning station L via a cleaning brush contained in a housing 66. The image area is then ready to begin a new marking cycle.

The various machine functions described above are generally managed and regulated by a controller which provides electrical command signals for controlling the operations described above.

Figure 3:
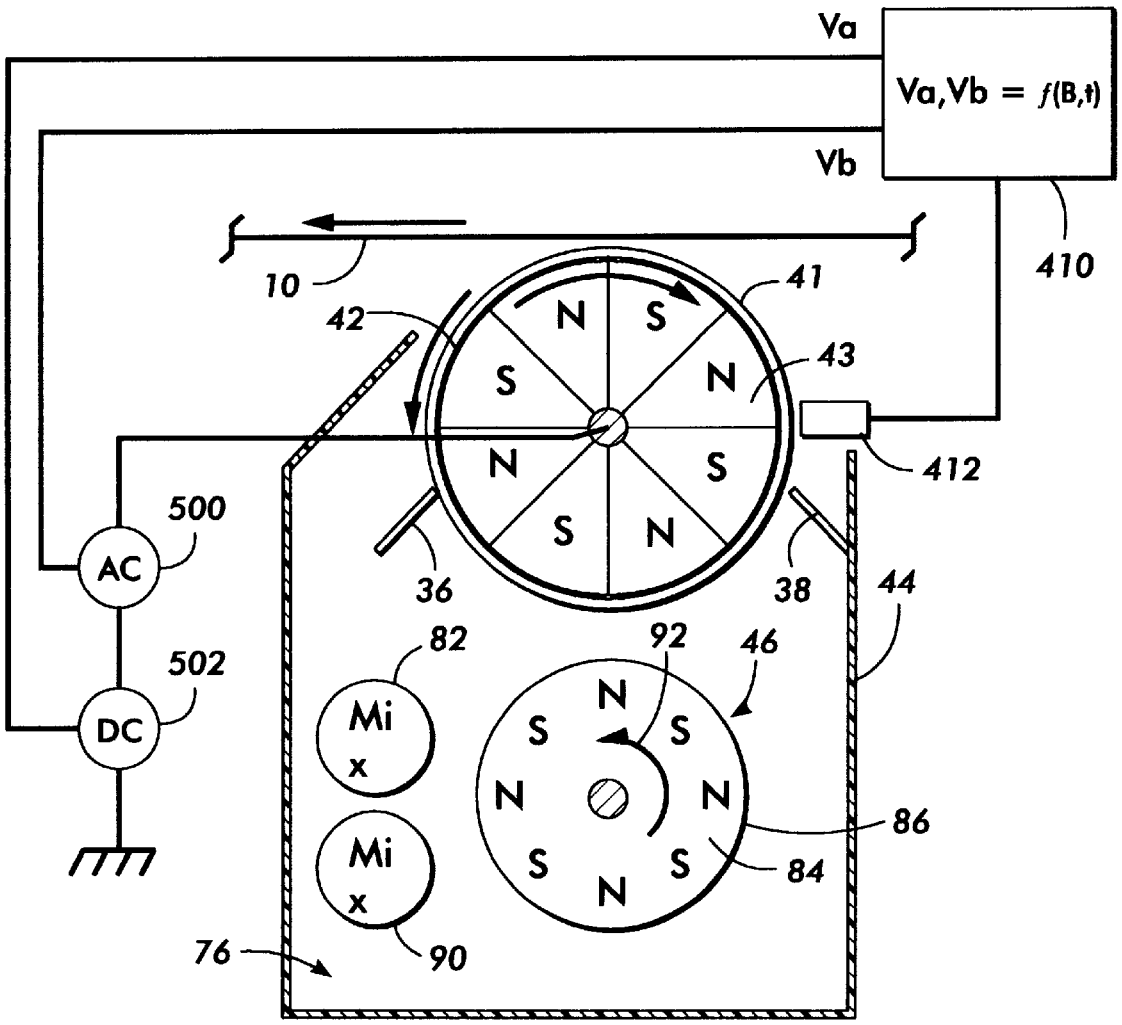
FIG. 3 is a schematic elevational view showing the development apparatus used in the FIG. 1 printing machine.

Referring now to FIG. 3 in greater detail, development system 34 includes a housing 44 defining a chamber 76 for storing a supply of developer material therein. Donor roll 42 comprises an interior magnetic assembly 43 and a outer sleeve 41. The sleeve is rotated in either the "with" or "against" direction relative to the direction of motion of the belt 10. Similarly, the magnetic assembly can be stationary or can be rotated in either the "with" or "against" direction relative to the direction of motion of the sleeve 41. In FIG. 3, sleeve is shown rotating in the direction of arrow 68, that is the "with" direction belt and magnetic assembly is rotated in the direction of an arrow. Doctor/trim blades 36 and 38 are placed in contact with the rotating donor roll 42 to continuously remove developer from the roll for return to the developer sump or chamber 76.

Magnetic roller 46 advances a constant quantity of developer having a substantially constant charge onto donor roll 40. This ensures that donor roller 40 provides a constant amount of toner having a substantially constant charge in the development zone. Metering blade 88 is positioned closely adjacent to magnetic roller 46 to maintain the compressed pile height of the developer material on magnetic roller 46 at the desired level. Magnetic roller 46 includes a nonmagnetic tubular member 86 made preferably from aluminum and having the exterior circumferential surface thereof roughened. An elongated magnet 84 is positioned interiorly of and spaced from the tubular member. The magnet is mounted stationary. The tubular member rotates in the direction of arrow 92 to advance the developer material adhering thereto into a loading zone. In loading zone, toner particles are attracted from the carrier granules on the magnetic roller to the donor roller. Augers 82 and 90 are mounted rotatably in chamber 76 to mix and transport developer material. The augers have blades extending spirally outwardly from a shaft. The blades are designed to advance the developer material in a direction substantially parallel to the longitudinal axis of the shaft.

The developer bed height compensation processor includes a sensor to measure the magnetic field of the roll at a position when that point of the roll advances to the development zone. A suitable sensor can be a hall effect sensor. The toner bed height control processor uses the magnetic field measurements to adjust the following parameters: developer roll bias voltage, developer roll AC frequency, AC waveshape, and AC peak to peak voltage, and DC offset bias voltage to maintain continuously a desirable electric field to reduce the toner bed height in the development zone.

Applicant has found that the Non Interactive Development process employs magnetic agitation of permanent magnet carriers to reduce the net adhesion of toners to carrier particles allowing them to be electrostatically stripped from the carriers and transported toward the developing electrostatic image through air in the form of a cloud. An issue unique to non-contact cloud development systems is the effect of lateral electric field components near the surface of the photoreceptor on the trajectories of toners transporting to the photoconductive surface. These lateral electric fields tend to divert toners away from image edges until development approaches neutralization.

For some applications the edge development characteristics of powders clouds are an attribute. Xeroradiographic images developed by powder cloud, for example, are uniquely able to show small changes in subject X-Ray absorption by virtue of the extreme edge development characteristics that occur in open (non-electroded) powder cloud development systems. For most applications, however, the edge development characteristics of powder clouds are a detriment. Uniform development that accurately replicates electrostatic latent image patterns is desired.

One approach to reducing this edge development effect is to increase the rate of developability. Given enough developed toner, the fringe fields become collapsed or otherwise sufficiently reduced to all toner to be developed into those areas otherwise umbrellaed by the fringe fields.

Figure 4:
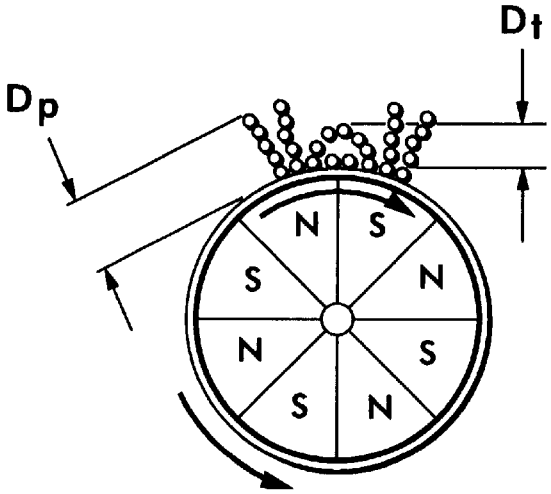
FIG. 4 illustrates variations in developer bed height on the donor roll.

In present invention, the magnetic agitation is provided by a rotating harmonic multipole magnetic roll concentric within a development roll surface on which the developer material walks.. The developer walking action is due to the response of the permanently magnetic carrier particles to the changes in magnetic field direction and magnitude caused by the internal rotating magnetic roll. The permanent magnet carriers are believed to rotate to align themselves with the magnetic field direction analogous to magnetic compass action. In addition, however, it is observed that carrier beads tend to align themselves into chains that extend normal to the development roll surface over pole faces and lay down parallel to the roll surface between pole faces where the magnetic field direction is tangent to the roll surface. The net result is that the effective developer bed height varies from a maximum over pole face areas to a minimum over the pole transition areas. This effect is illustrated below in FIG. 4.

The present invention minimizes the variation in the developer bias fields that result from the variation in developer bed height.

In the present invention electric fields within the development nip are tailored to compensate for the changes in developer bed height that occur in the nip. Levels of AC bias peak to peak voltage, DC offset bias, and AC bias frequencies that would cause bed/photoreceptor contact and background development when the bed is at its highest can thus be employed when the bed is not at its highest. In particular, the biases can be continuously biased such that the development fields are always such as to produce the maximum amount of development rate throughout the entirety of the pole to pole cycle without bed/photoreceptor contact and/or background development. The principle of the present invention was tested with a developer apparatus as shown in FIG. 3. A 4" by 4" piece of NESA glass was employed as a stationary toner receiver for the developer sub-system. The conductive coating on the NESA glass was divided into two regions electrically isolated from each other by a line mechanically etched through the coating. The two halves of the conductive coating were thus individually biased to provide a development field for one half and a cleaning field for the other half when positioned close to the developer roll. Electronic circuitry was designed and built to allow modulation of the AC bias peak to peak voltage, AC bias frequency, and DC offset bias as a function of the instantaneous voltage output of an inductive pickup radially positioned near the roll as to output positive and negative peaks of the sinusoidal output when magnetic poles, both North and South, were centered in the development nip between the developer roll and the NESA plate conductive regions. The dividing line between the two regions of the NESA plate was arranged to be parallel to the process direction, or in this case more specifically, the developer bed movement.

The control conditions for operating the experiment first with no modulations of bias of any kind were:

| | |
|---|---|
| AC Bias Frequency: 4 kHz | AC Bias peak/peak Voltage: 2500 Volts p/p |
| DC Offset Bias: −100 Vdc | Mag Core rotation rate: 300 pole transitions/second |
| Dev. Bed Height (measured with a standard DBH gauge) | 0.023" |
| Dev. Roll to Toner Receiver plate: 0.027" | Shell Rotation: 2.5"/sec. surface speed with motion |
| Development Field NESA Plate Coating Bias: −400 Vdc | |
| Cleaning Field NESA Plate Coating Bias: 0 Vdc | Development cycle time length: 6 pole transitions |

In the desired Non-Interactive-Development mode it is believed that carrier beads must be prevented from touching the photoreceptor surface. This is to prevent disturbance of previously developed toner image patterns that are being combined on the photoreceptor surface to create composite color images. The variation in developer bed height illustrated in FIG. 4 forces the minimum spacing between the photoreceptor and the developer bed surface to be determined by the bed height at the pole areas where the bed height $D_p$ is largest in order to prevent interaction. This minimum spacing between the photoreceptor and the developer bed surface dictates the maximum AC bias peak to peak voltage, the minimum frequency of the same, and the maximum DC offset bias that can be applied without causing contact between the p/r surface and the carrier beads, and without causing toner to be deposited on areas of the photoreceptor where it is not intended (background development).

Since a stationary toner receiver was being employed instead of a rotating drum or moving belt, it was necessary to apply a DC offset bias to the developer roll EXCEPT during the development cycle. The circuitry provided allowed the development cycle to commence when the developer brush in the nip was the lowest (two poles of the core were equidistant up/downstream from the center of the nip), and to continue for DIP switch selectable 2, 4, 6, 8, 10, or 12 whole pole cycles. During that time, the biasing as described above was applied, modulated by FM, AM, or DC offset or any permutation of up to the entire three techniques.

Before the development cycle, when the equipment was being readied for the measurement, and after the development cycle, when the equipment was being shut down after the experiment, the DC offset bias to the roll was changed to a steady-state value of −200 Vdc (positive sign toner was being used). This kept any space charge or otherwise induced development from affecting the weight of the total toner being developed during the desired time (cycle).

For the control conditions described above, with NO MODULATION of ANY KIND, the weight of the toner developed was 0.00375 grams, measured by weighing a toner filter first, and then again after being used to entrap the toner sucked from the NESA plate through the filter with a partial vacuum.

It was found that approximately one half again as much toner can be developed by simultaneous employment of 2 or all 3 techniques without any detectable amounts of background development while minimizing the variation in developer height.

While the invention has been described with reference to the structures disclosed, it is not confined to the specific details set forth, but is intended to cover such modifications or changes as may come within the scope of the following claims:

What is claimed is:

1. In a development system including a developer transport adapted for depositing developer material on an imaging surface having an electrostatic latent image thereon, comprising:

a housing defining a chamber storing a supply of developer material comprising toner;

a donor member, mounted partially in said chamber and spaced from the imaging surface, for transporting toner on an outer surface thereof to a region opposed from the imaging surface, said toner donor member having a magnetic assembly having a plurality of poles, a sleeve, enclosing said magnetic assembly, rotating about said magnetic assembly;

a sensor for measuring a magnetic field of said donor roll at a predefined position on said donor roll; and means, responsive to sensor, for generating an electric field.

2. The development system of claim 1, further comprising a power supply for biasing said donor member.

3. The development system of claim 2, further comprising a control system, responsive to said sensor, for controlling said power supply.

4. The development system of claim 3, wherein said control system adjusts the donor member biasing voltages, in response to the measured magnetic field.

5. The development system of claim 3, wherein said control system adjusts the frequencies of said power supply.

6. The development system of claim 3, wherein said control system adjusts the wave form of said power supply.

* * * * *